US008863362B2

(12) United States Patent
Kelleghan

(10) Patent No.: US 8,863,362 B2
(45) Date of Patent: Oct. 21, 2014

(54) SIDE SQUEEZE BUCKLE WITH INTEGRATED LED LIGHT

(71) Applicant: Bison Designs, LLC, Longmont, CO (US)

(72) Inventor: Brian James Kelleghan, Longmont, CO (US)

(73) Assignee: Bison Designs, LLC, Longmont, CO (US)

( * ) Notice: Subject to any disclaimer, the term of this patent is extended or adjusted under 35 U.S.C. 154(b) by 6 days.

(21) Appl. No.: 13/841,046

(22) Filed: Mar. 15, 2013

(65) Prior Publication Data

US 2014/0109360 A1 Apr. 24, 2014

Related U.S. Application Data

(60) Provisional application No. 61/693,667, filed on Aug. 27, 2012.

(51) Int. Cl.

| | |
|---|---|
| ***A44B 11/26*** | (2006.01) |
| *A44B 15/00* | (2006.01) |
| *A44C 5/20* | (2006.01) |

(52) U.S. Cl.

CPC ..... *A44B 11/266* (2013.01); *A44B 15/005* (2013.01); *A44C 5/2052* (2013.01)

USPC ..... 24/615; 24/625

(58) Field of Classification Search

USPC ..... 24/614–616, 625, 629, 633

See application file for complete search history.

(56) References Cited

U.S. PATENT DOCUMENTS

| | | | |
|---|---|---|---|
| 734,167 | A | 7/1903 | Gaisman |
| 4,177,522 | A | 12/1979 | Auburn |
| D296,310 | S | 6/1988 | Crowle |
| D303,233 | S | 9/1989 | Jang |
| 5,073,989 | A | 12/1991 | Teague |
| D349,262 | S | 8/1994 | Krauss |

(Continued)

FOREIGN PATENT DOCUMENTS

| | | |
|---|---|---|
| EP | 0880913 | 12/1998 |

OTHER PUBLICATIONS

Instructables search results for "survival bracelet" Scan of website [http://www.instructables.com/pages/search/search.jsp?cx=partner-pub-1783560022203827%3Anpr2q7v5m6t&cof=FORID%3A11&ie=ISO-8859-1&q=survival+bracelet] showing prior art bracelets. The bracelets shown are admitted prior art to current design by Applicant.

(Continued)

*Primary Examiner* — Robert J Sandy
*Assistant Examiner* — Abigail Morrell
(74) *Attorney, Agent, or Firm* — Margaret Polson; Polson & Associates, PC

(57) ABSTRACT

A side squeeze buckle with a cavity formed in a central section of the male section of the buckle is disclosed. The cavity can have an LED light enclosed therein or can be left as an open cavity to store items. The female section of the buckle has two arms extending around a central opening. The central section of the male section fits into the central opening of the female section. The external surface of the cavity forms a substantial portion of the top surface of the buckle when the buckle is closed.

11 Claims, 9 Drawing Sheets

(56) References Cited

U.S. PATENT DOCUMENTS

| | | | | |
|---|---|---|---|---|
| D381,936 | S | 8/1997 | Anscher | |
| D385,826 | S | 11/1997 | Anscher | |
| 5,743,621 | A * | 4/1998 | Mantha et al. | 362/105 |
| D424,977 | S | 5/2000 | Anscher | |
| 6,311,374 | B1 * | 11/2001 | Anscher | 24/625 |
| 6,805,460 | B1 | 10/2004 | Zoller et al. | |
| D516,754 | S | 3/2006 | Curtis | |
| D516,756 | S | 3/2006 | Curtis | |
| 7,020,939 | B2 * | 4/2006 | Anscher | 24/625 |
| 7,055,226 | B2 * | 6/2006 | Uehara et al. | 24/625 |
| 7,100,252 | B2 * | 9/2006 | Anscher | 24/615 |
| 7,219,406 | B2 | 5/2007 | Chui | |
| 7,320,160 | B2 * | 1/2008 | Uehara et al. | 24/615 |
| 7,377,665 | B2 * | 5/2008 | Langenwalter | 362/103 |
| D591,642 | S | 5/2009 | Henderson et al. | |
| 7,566,140 | B2 | 7/2009 | Sevilla | |
| 7,650,676 | B2 * | 1/2010 | Saitsu | 24/615 |
| D656,297 | S | 3/2012 | Christian | |
| D679,623 | S | 4/2013 | Maier | |
| D681,498 | S | 5/2013 | Kornerup | |
| 2002/0092140 | A1 | 7/2002 | Van Tassel | |
| 2003/0074772 | A1 | 4/2003 | Chen | |
| 2006/0272136 | A1 | 12/2006 | Chui | |
| 2008/0134479 | A1 | 6/2008 | Kolasa et al. | |
| 2008/0178438 | A1 * | 7/2008 | Yoshie et al. | 24/616 |
| 2008/0185409 | A1 | 8/2008 | Kellenberger | |
| 2011/0048072 | A1 | 3/2011 | Mullen et al. | |
| 2011/0252649 | A1 | 10/2011 | Lovitz | |
| 2012/0159987 | A1 | 6/2012 | Walchle et al. | |
| 2013/0031935 | A1 | 2/2013 | Kelleghan | |

OTHER PUBLICATIONS

Instructables search results for "paracord bracelet with a side release" Scan of website [http://www.instructables.com/pages/search/search.jsp?cx=partner-pub-1783560022203827%3Anpr2q7v5m6t&cof=FORID%3A11&ie=ISO-8859-1&q=paracord+bracelet+with+a+side+release] showing prior art bracelets. The bracelets shown are admitted prior art to current design by Applicant.

Paracord bracele with a side release buckle Scan of website [http://www.instructables.com/id/Paracord-bracelet-with-a-side-release-buckle/] showing prior art bracelet authored by Stormdrane. The bracelet shown is admitted prior art to current design by Applicant.

Stormdrane's Blog Scan of website [http://stormdrane.blogspot.com/2006_02_01_archive.htm] showing prior art bracelets. The bracelets shown were all posted in Feb. 2006 and are admitted prior art to current design by Applicant.

Survival Bracelet (Updated) Scan of website [http://www.instructables.com/id/Survival-Bracelet/] showing prior art bracelet authored by tevers94. The article shown has an index date of Jan. 27, 2010 and is admitted prior art to current design by Applicant.

www.Survival-Bracelets.com Scan of website [http://www.survival-bracelets.com/survival_bracelets] showing prior art bracelets. The bracelets shown are admitted prior art to current design by Applicant.

Blade HQ Scan of website [http://www.bladehq.com/cat--Survival-Bracelets--437] showing prior art bracelets. The bracelets shown are admitted prior art to current design by Applicant.

Messina's Front Line Survival Gear Para Cord Survival Bracelet Scan of website [http://www.flsgear.com/index.php?c=survival&n=3375251&k=para+cord+survival+bracelet&s=rc&p=2&x=Survival_para_cord_survival_bracelet] showing prior art bracelets. The bracelets shown are admitted prior art to current design by Applicant.

Paracord Paul's Outpost Paracord Survival Bracelets Scan of website [http://www.paracordpaulsoutpost.com/cat-paracord-bracelets.cfm] showing prior art bracelets. The bracelets shown are admitted prior art to current design by Applicant.

U.S. Cavalry 550 Paracord Survival Bracelet Scan of website [http://www.uscav.com/productinfo.aspx?productID=21100&TabID=548] showing a prior art bracelet. The bracelet shown is admitted prior art to current design by Applicant.

Amazon search results for "Survival Bracelet" Printout of results of an Amazon search for sellers utilizing the term "survival bracelet". The bracelets shown are admitted prior art to current design by Applicant.

Google search results for "Survival Bracelet" Printout of first 4 pages of results of a Google search for the term "survival bracelet". The bracelets shown are admitted prior art to current design by Applicant.

http://2.bp.blogspot.com/-xzq ILFpj3ZY/T4ngor2BM41/AAAAAAAAAAy/sm0cvGsGUEI/s1600/BO09WT202.jpg . Accessed May 15, 2013. The bracelet shown is admitted prior art to current design by Applicant.

http://images2.opticsplanetcom/365-240-ffffff/opplanet-boker-usa-plus-survival-bracelet-olive-9in-09jg233-main.jpg. Accessed May 15, 2013. The bracelet shown is admitted prior art to current design by Applicant.

http://willowhavenoutdoor.com/wp-content/uploads/2011/02/olive-drab-para-cord-bracelet.jpg. Accessed May 15, 2013. The bracelet shown is admitted prior art to current design by Applicant.

U.S. Appl. No. 29/394,324, filed Jun. 15, 2011; First Named Inventor: Brian James Kelleghan.

U.S. Appl. No. 29/398,304, filed Jul. 28, 2011; First Named Inventor: Brian James Kelleghan.

U.S. Appl. No. 29/422,111, filed May 16, 2012; First Named Inventor: Brian James Kelleghan.

U.S. Appl. No. 29/448,729, filed Mar. 13, 2013; First Named Inventor: Brian James Kelleghan.

U.S. Appl. No. 29/448,779, filed Mar. 13, 2013; First Named Inventor: Brian James Kelleghan.

U.S. Appl. No. 29/443,676, filed Jan. 21, 2013; First Named Inventor: Brian James Kelleghan.

* cited by examiner

SIDE SQUEEZE BUCKLE WITH INTEGRATED LED LIGHT

CROSS REFERENCE APPLICATIONS

This application is a non-provisional application which claims the benefits of provisional application No. 61/693,667 filed on Aug. 27, 2012, which is hereby incorporated by reference for all purposes.

BACKGROUND

Side squeeze buckles, also called side release buckles, are well known in the art. They come in a wide variety of sizes and configurations, depending on the intended use. These buckles typically include a female receptacle or socket section which is engageable with a male latch or plug section. One or both of the sections adjustably or fixedly holds a strap or belt around crossbars or the like.

Some attempts have been made to incorporate lights into buckles, including side squeeze buckles. These have resulted in either large, clunky buckles and/or lights and their wiring that are not entirely enclosed within the buckle.

The foregoing example of the related art and limitations related therewith are intended to be illustrative and not exclusive. Other limitations of the related art will become apparent to those of skill in the art upon a reading of the specification and a study of the drawings.

SUMMARY

One aspect of the present disclosure is to provide a size squeeze buckle that has a LED light integrated within the male part of the buckle, particularly a buckle that is small enough to be used on a bracelet or small dog collar.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

In one embodiment a side squeeze buckle has a male latch and female receptacle as with prior art buckles. A cavity is built into the male part that has a self-contained LED light and switch mechanism. In one embodiment the cavity is water resistant.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 5:
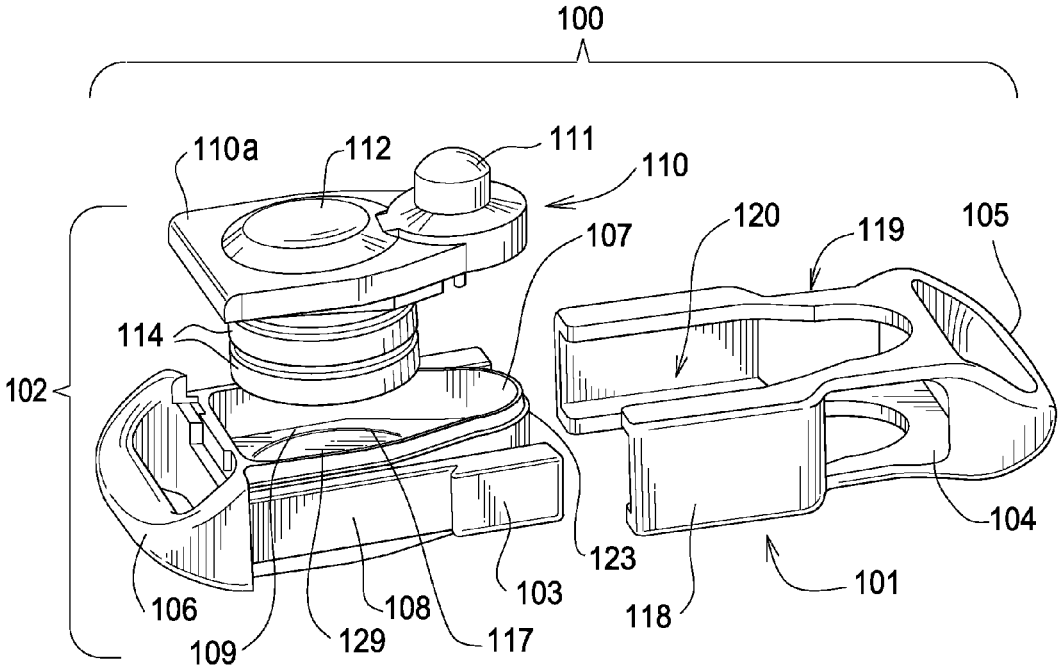
FIG. 5 is an exploded view of the buckle and light.

Referring first to FIGS. 1 to 4 the side squeeze buckle 100 has a female receptacle section 101 and a male latch section 102 which functions similar to known prior art side squeeze buckles. The male latch section 102 has a pair of arms 108 with tabs 103 on each side that engage holes 104 on the female 101 side to lock the buckle 100 together. The buckle 100 is made from a substantially rigid material such as plastic that retains its shape but can be flexed enough to press the tabs 103 inward enough to disengage the tabs 103 from the holes 104 to allow the two sections to be pulled apart, as can be seen in FIG. 5. One or both of the sections adjustably or fixedly holds a strap or belt around crossbars or the like. In the depicted embodiment, each section has an attachment location 105 and 106, which are single slots. Other known attachment locations could be used as well, including multiple slots for adjustable connections to straps, round holes or other known forms. No limitation is intended or inferred.

Figure 1:
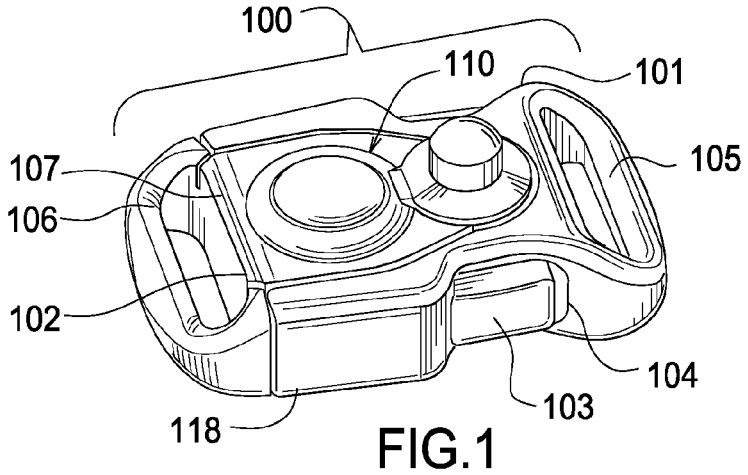
FIG. 1 is a top perspective view of a size squeeze buckle with integrated light.
Figure 2:
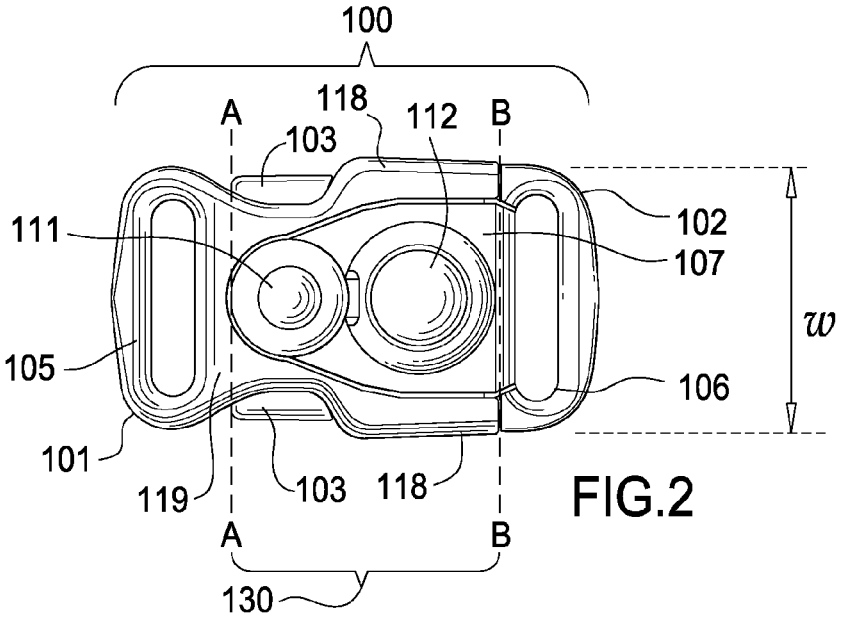
FIG. 2 is a top plan view of FIG. 1.
Figure 9:
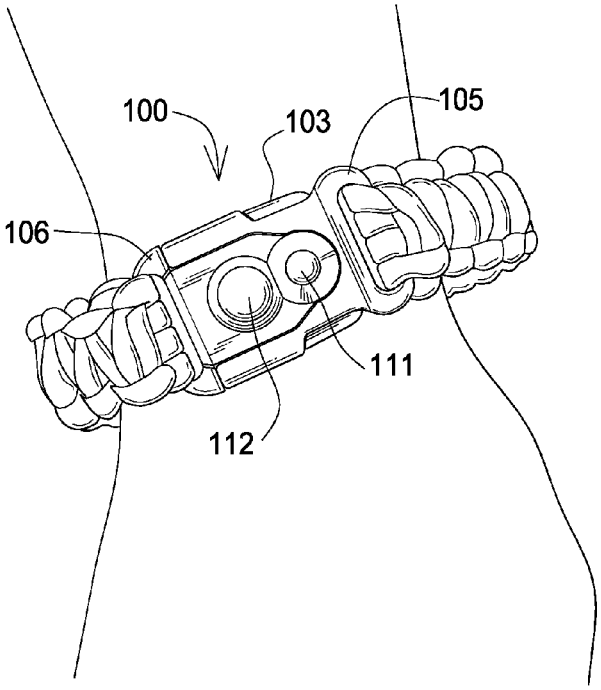
FIG. 9 is a top perspective view of the buckle as part of a bracelet on a wrist.

The male section 102 has a central section 107 extending from the attachment location 105 and flanked on two sides by arms 108 bearing tabs 103, as can be seen in FIG. 5. The two arms 108 are spaced apart from the central section enough to allow the arms 108 to be flexed inward enough allow the buckle 100 to open as described above. The central section 107 has a cavity 109 with a lid 110. In the current disclosure, the lid 110 and the bottom surface 125 of the central section 120, seen in FIGS. 1 and 4, form a large section of the top and bottom surface of the closed buckle. The female section 101 has two arms 118 extending around a central opening 120. The two arms 118 have recesses 104 that interlock with the tabs 103 of the male section 102. The shape of the central opening 120 of the female section 101 corresponds to the shape of the central section 107 of the male section, forming an interlocked whole. The female section has a top surface 119 and a bottom surface 124. The top surface 126 of the closed buckle 100 is formed by the top surface 110*a* of the lid and the top surface 119 of the female section 101, as seen in FIGS. 2 and 9. The interlock of the two surfaces must be close enough that there are no large gaps that could be snagged or otherwise caught. The top surface 110*a* of the male section forms at least 50 percent of the top surface 126 of the closed buckle. When the buckle is closed, the two sections interlock, such that the interlocked parts form the majority of the buckle. Lines A and B in FIG. 2 indicate the end points of the male and female sections respectively in the closed buckle. The part of the buckle between lines A and B is the interlocked section 130. In most side squeeze buckles only the attachment locations are outside of the interlocked section.

Figure 7:
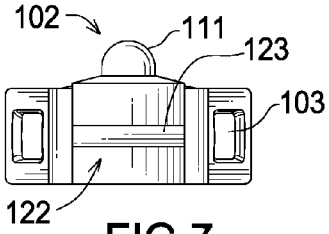
FIG. 7 is a side elevation view of the female section of the buckle.
Figure 8:
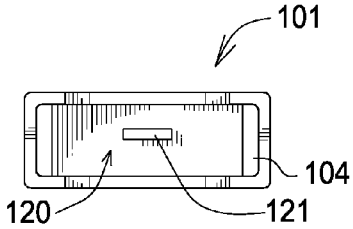
FIG. 8 is a side elevation view of the male section of the buckle

Referring next to FIGS. 7 and 8, in some embodiments of the buckle the female section 101 has a stabilizing member 121 inside the central opening 120 extending from the back wall 130. The stabilizing member 121 engages with slot 123 in the front end 122 of the central section 107 of the male section 102 when the buckle is closed. The interlocking of the stabilizing member 121 and slot 123 helps stabilize the closed buckle in place, helping to prevent flexing of the closed buckle.

Figure 6:
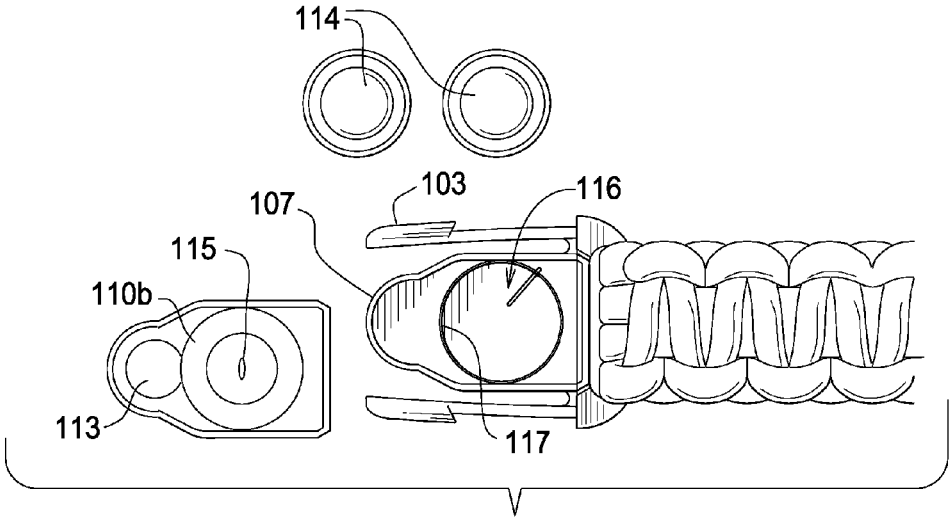
FIG. 6 is a top plan view of the male side of the buckle with the cover and batteries removed.

The lid 110 has LED 111 and switch 112 integrated onto the top surface 110*a* of the male section 102 in the depicted embodiment. In this configuration the LED acts as a blocking element to reduce the likelihood of the button being activated by accident. The LED could be recessed if desired. As will be discussed below, the light and the switch can be at other locations; no limitation as to their locations other than as claimed is intended or should be inferred. Furthermore, the buckle can have more than one LED and/or switch. If desired flashlight type mount of the LED can be used to provide a highly directional beam of light. As can be seen in FIG. 6 the circuit board 113 for controlling the light 111 is attached to the bottom surface 110*b* of the lid 110 in the depicted embodiment. The circuit board could be located in other locations as well. At least one battery 114 is placed in cavity 109 such that it contacts leads 115, 116 to create a complete circuit to provide power for the light 111. The remainder of the circuit between the battery and the light is not shown for clarity of the drawings.

Cavity 109 has ridge 117 extending across it to brace the external walls and to form a battery cavity 129 in the depicted embodiment. Switch 112 is a simple push button switch with flexible rubber cover in the depicted embodiment. Other types of switches could be used as well, including lever switches and other known types. The LED light has three modes in the depicted embodiment: on, off and flashing. Depressing the switch 112 changes the mode of the light 111. In the depicted embodiment the light modes are in the order of on, flashing, off and have to be cycled through in that order. Other designs of the switch and the mode are possible.

Figure 3:
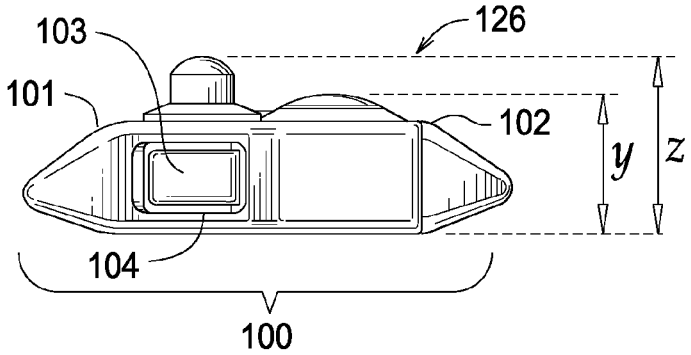
FIG. 3 is side plan view of the buckle.
Figure 4:
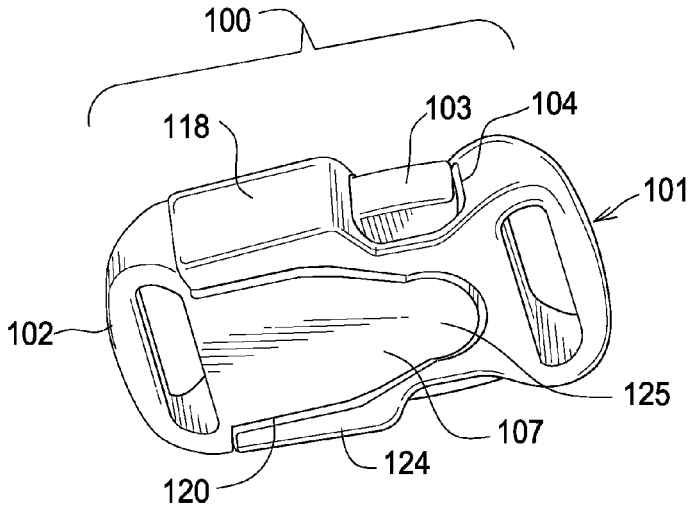
FIG. 4 is a bottom perspective view of the buckle.

In the preferred embodiment the buckle is small enough to use as a buckle on a bracelet, as seen in FIG. 9. The buckle has a length X, a width W, a height to the top of the lid of Y and a height to top of the light of Z as seen in FIGS. 2 and 3. In the preferred embodiment the nominal dimensions are X=32 mm, W=22 mm, Y=9 mm, Z=14 mm. A larger version (not shown) has nominal dimensions of X=45 mm, W=30 mm with approximately the same Y and Z values.

Figure 11:
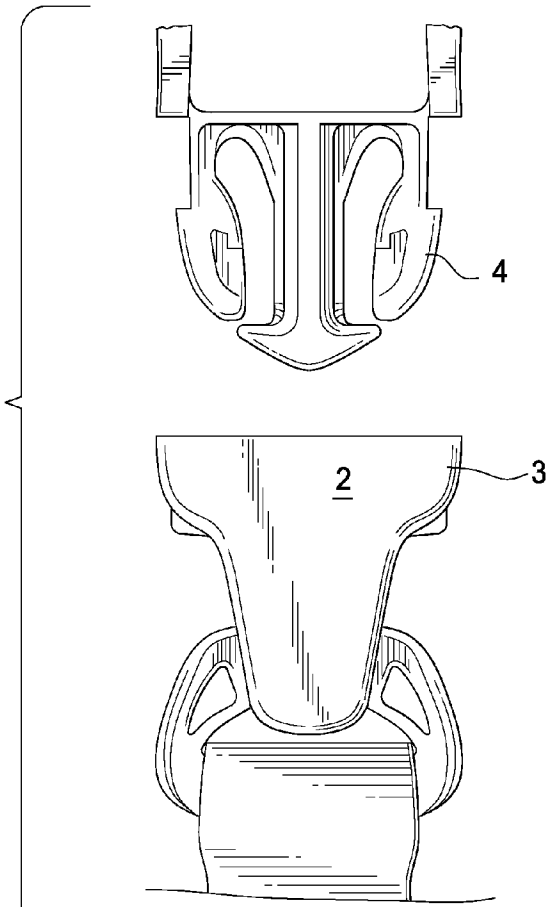
FIG.11 (PRIOR ART)
FIG. 11 is a prior art side squeeze buckle separated.
Figure 10:
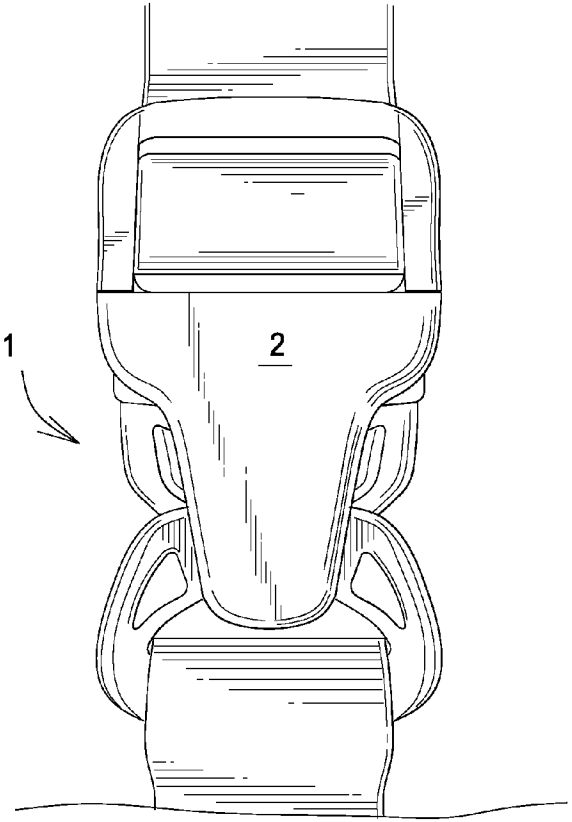
FIG.10 (PRIOR ART)
FIG. 10 is a prior art side squeeze buckle.

As can be seen in FIGS. 10 and 11, in prior art side squeeze buckles 1 the female par 2 largely encloses the male part 4 with the female part 2 forming the top surface 3 of the buckle 1 when the parts are locked together. In the areas of the buckle when closed, the female part is the entire top surface of the buckle.

Figure 12:
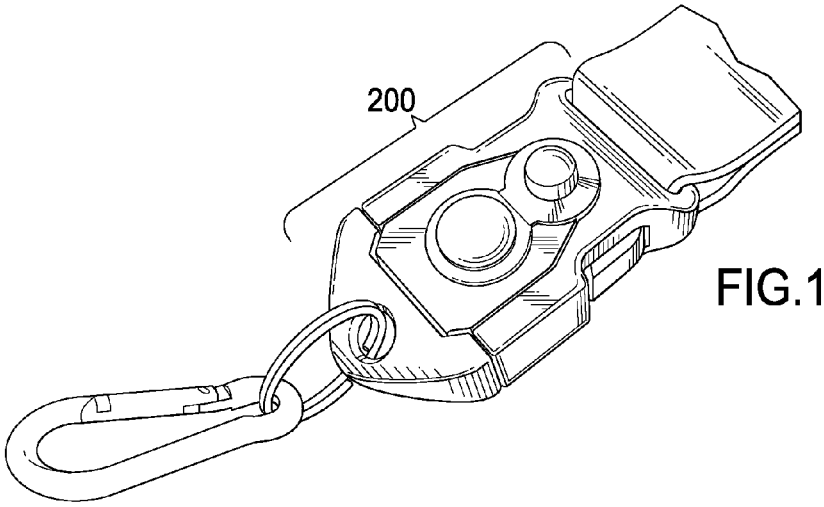
FIG. 12 is a top perspective view of a second embodiment of the side squeeze buckle.
Figure 13:
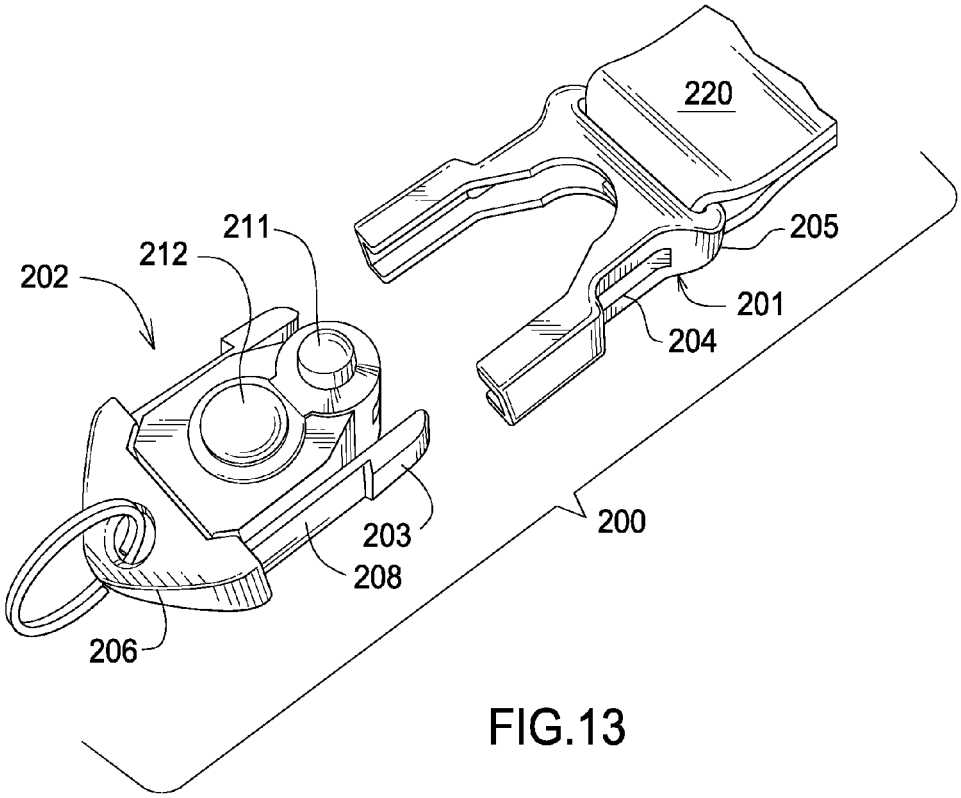
FIG. 13 is an exploded view of the second embodiment of the side squeeze buckle of FIG. 12.

FIGS. 12 to 13 depict another embodiment of the buckle 200 where one of the attachment locations 206 is a hole, allowing a key ring or other device different from the flexible member 220 to be attached on the other attachment location 205. This allows the side squeeze buckle 200 to be used as a key fob or for other uses. As before, buckle 200 has a female receptacle section 201 and a male latch section 202. The male latch section 202 has a pair of arms 208 with tabs 203 on each side that engage holes 204 on the female 201 side to lock the buckle 200 together as described above. The button 212 and LED 211 are located as described above.

Figure 14:
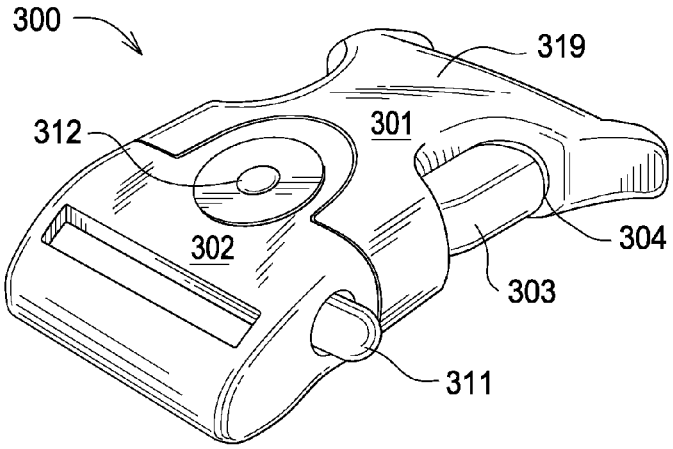
FIG. 14 is a perspective view of a third embodiment of the side squeeze buckle.
Figure 15:
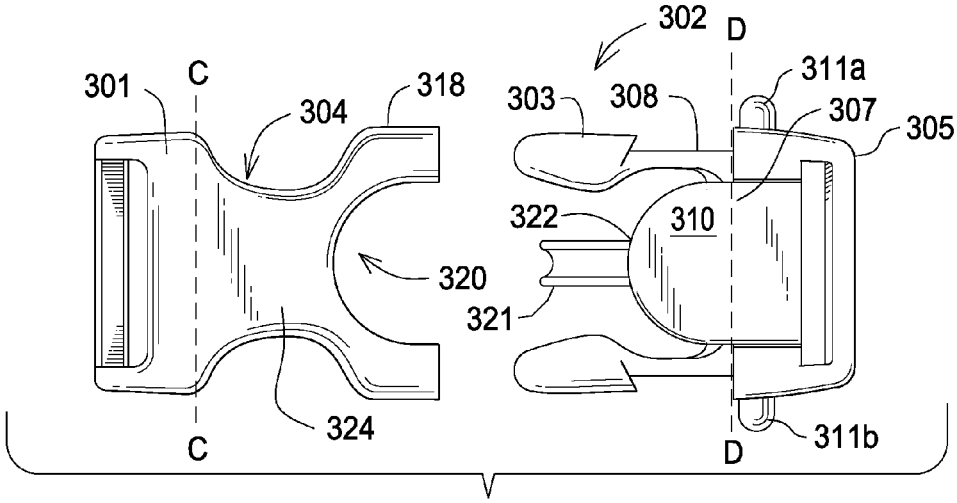
FIG. 15 is an exploded view of the third embodiment of the side squeeze buckle.

Referring next to FIGS. 14 and 15, another embodiment of the buckle 300 is shown. The side squeeze buckle 300 has a female receptacle section 301 and a male latch section 302 which function as described above. The male latch section 302 has a pair of arms 308 with tabs 303 on each side that engage holes 304 as before.

The male section 302 has a central section 307 extending from the attachment location 305 and flanked on two sides by arms 308 bearing tabs 303, as can be seen in FIG. 15. The two arms 308 are spaced apart from the central section 307 enough to allow the arms 308 to be flexed inward enough allow the buckle 300 to open as described above. The central section 307 has a cavity with a lid 310. In the current disclosure, the lid 310 and the top surface 325 of the central section 307, seen in FIGS. 14 and 15, form a large section of the top and bottom surface of the closed buckle. The female section 301 has two arms 318 extending around a central opening 320. The shape of the central opening 320 of the female section 301 corresponds to the shape of the central section 307 of the male section, forming an interlocked whole. The female section has a top surface 319 and a bottom surface 324. The bottom surface 324 of the closed buckle 300 is formed by the top surface of the lid 310 and the bottom surface 324 of the female section 301, as seen in FIG. 14. When the buckle is closed, the two sections interlock, such that the interlocked parts form the majority of the buckle. Lines C and D in FIG. 15 indicate end points of the male and female sections respectively in the closed buckle. In the embodiment 300, the cavity for the LED and electronics extends beyond the overlap into the part of the male section that is not overlapped by the female section when the buckle is closed, as seen in FIG. 14.

The male section 302 has a stabilizing member 321 extends from the front end 322 of the central section 307 of the male section 302. The stabilizing member 321 interlocks with the female section to stabilize the closed buckle in place, helping to prevent flexing of the closed buckle.

The top of the male section 302 has switch 312 integrated onto the top surface in the depicted embodiment. As can be seen in FIG. 15, the two LEDs 311*a*, 311*b*, extend outward from the male section on the side and behind the line D.

Figure 16:
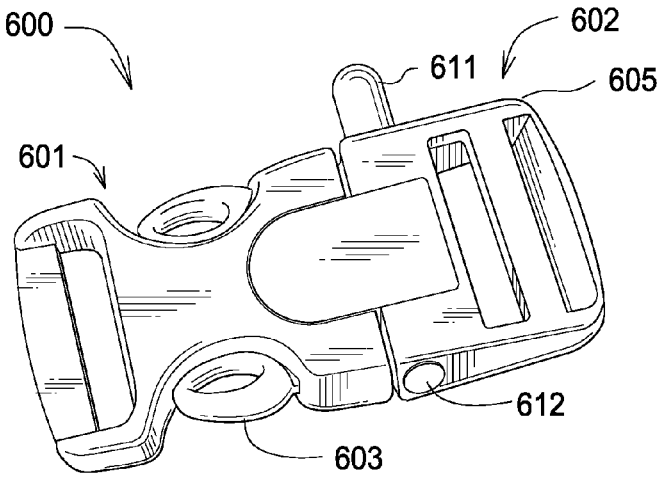
FIG. 16 is a perspective view of a fourth embodiment of the side squeeze buckle.
Figure 17:
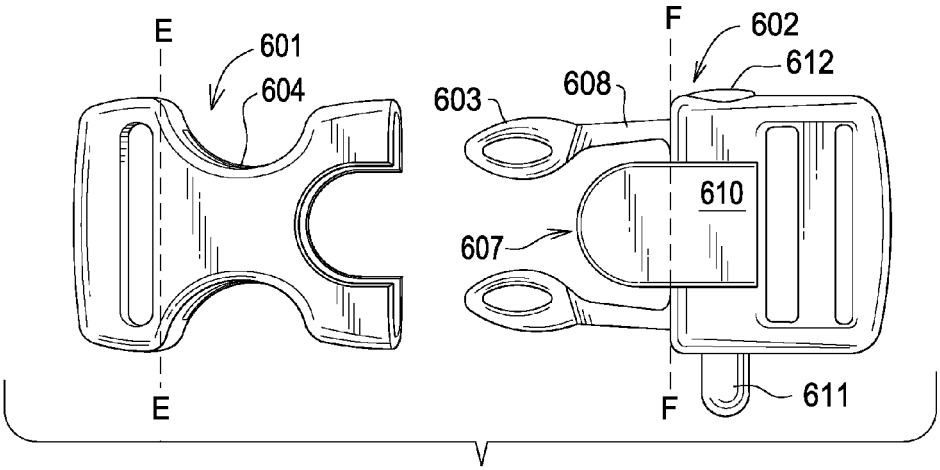
FIG. 17 is an exploded view of the fourth embodiment of the side squeeze buckle.

Referring next to FIGS. 16 and 17, another embodiment of the buckle 600 is shown. The side squeeze buckle 600 has a female receptacle section 601 and a male latch section 602 which function as described above. The male latch section 602 has a pair of arms 608 with tabs 603 on each side that engage holes 604 as before.

The male section 602 has a central section 607 extending from the attachment location 605 and flanked on two sides by arms 608 bearing tabs 603, as can be seen in FIG. 17. The two arms 608 are spaced apart from the central section 607 as described above. The central section 607 has a cavity with a lid 610. Lines E and F in FIG. 17 indicate end points of the male and female sections respectively in the closed buckle. In the embodiment 600, the cavity for the LED and electronics extends beyond the overlap into the part of the male section that is not overlapped by the female section when the buckle is closed, as seen in FIG. 16.

In this embodiment the switch 612 is on the side of the male section on the opposite side from the LED 611, as can be seen in FIG. 17. These are behind the line F and will be beyond the overlap area when the buckle 600 is closed.

Figure 18:
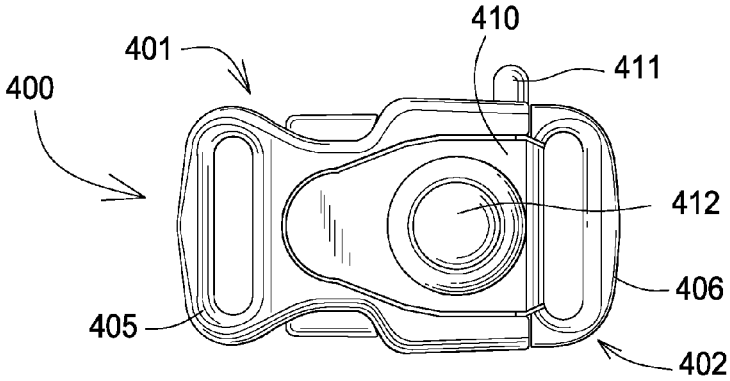
FIG. 18 is a top plan view of a fifth embodiment of the side squeeze buckle.
Figure 19:
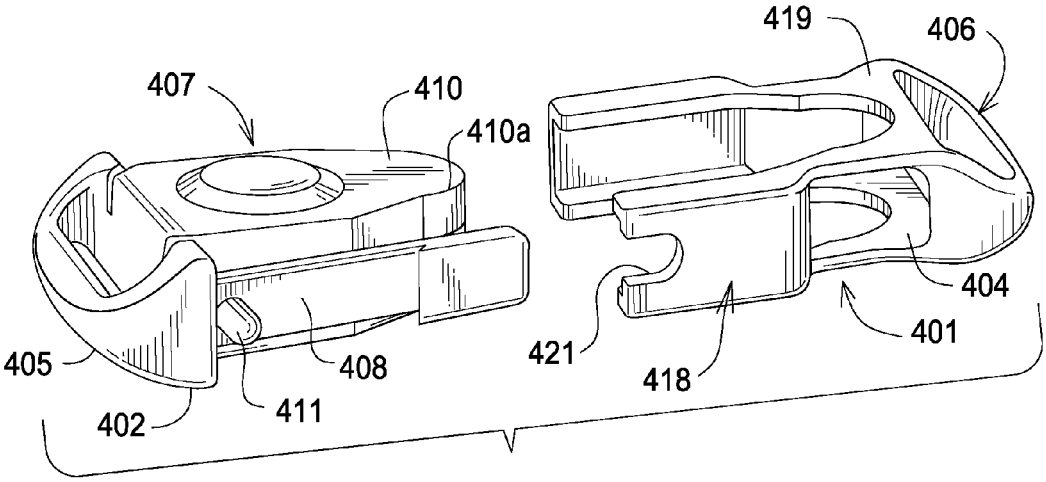
FIG. 19 is an exploded view of the fifth embodiment of the side squeeze buckle.

Referring next to FIGS. 18 and 19, a third embodiment of the side squeeze buckle 400 has a female receptacle section 401 and a male latch section 402 which function identically to the buckles 100, 300 discussed above with respect to the interlocking of the two sections. The male latch section 402 has a pair of arms 408 with tabs 403 on each side that engage holes 404 on the female 401 side to lock the buckle 400 together. The buckle 400 is made from a substantially rigid material such as plastic that retains its shape but can be flexed enough to press the tabs 403 inward enough to disengage the tabs 403 from the holes 404 to allow the two sections to be pulled apart, as can be seen in FIG. 19. In the depicted embodiment, each section has an attachment location 405 and 406, which are single slots. Other known attachment locations could be used as well, including multiple slots for adjustable connections to straps, round holes or other known forms. No limitation is intended or inferred.

The male section 402 has a central section 407 extending from the attachment location 405 as described above. The central section 407 has a cavity (not shown) with a lid 410. In the current disclosure, the lid 410 and the bottom surface of the central section 420, seen in FIG. 18, form a large section of the top and bottom surface of the closed buckle. The two sections interlock as described above. The shape of the central opening 420 of the female section 401 corresponds to the shape of the central section 407 of the male section, forming an interlocked whole. The female section has a top surface 419 and a bottom surface (not shown). The top surface of the closed buckle 400 is formed by the top surface 410*a* of the lid and the top surface 419 of the female section 401.

The lid 410 has a switch 412 integrated onto the top surface 410*a* of the male section 402 in the depicted embodiment. The interior of the cavity, the lid and the rest of the workings of the LED are as discussed above. In this embodiment, the LED extends out of the side of the male section 401. At least one of the extending arms 418 of the female section has a recess 421 that fits around the LED 411, as seen in FIG. 19.

Figure 20:
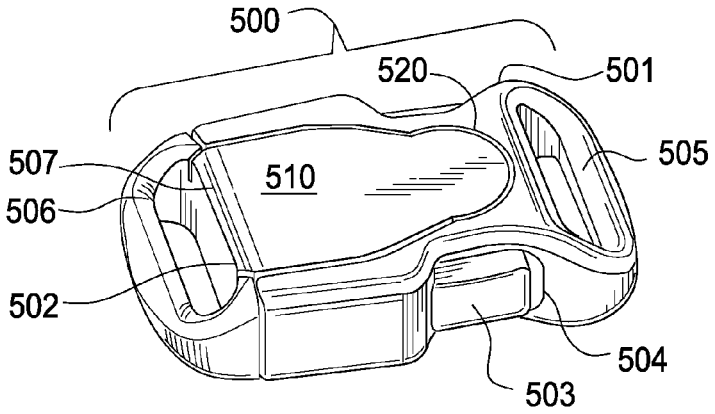
FIG. 20 is a perspective view of a sixth embodiment of the side squeeze buckle.
Figure 21:
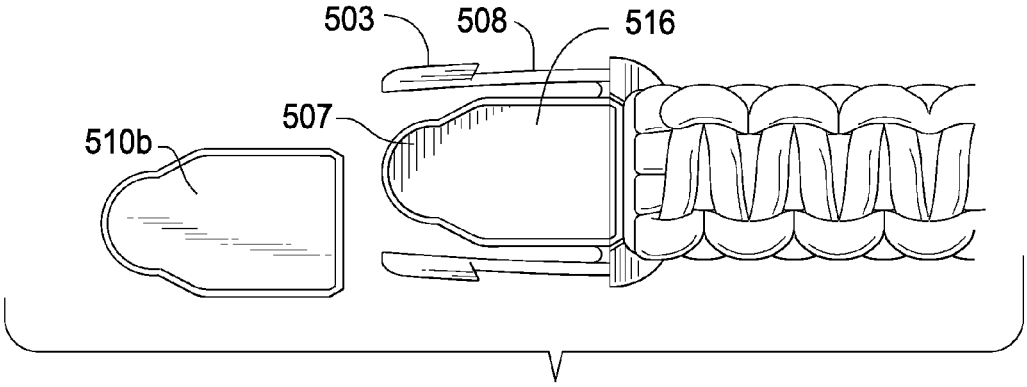
FIG. 21 is a top plan view of the male section of the buckle with the lid removed.

Referring next to FIGS. 20 and 21, another embodiment of the side squeeze buckle 500 has also has a female receptacle section 501 and a male latch section 502 which function identically to the buckles 100, 300 discussed above with respect to the interlocking of the two sections. The male latch section 502 has a pair of arms 508 with tabs 503 on each side that engage holes 504 on the female 501 side to lock the buckle 500 together. In the depicted embodiment, each section has attachment locations 505 and 506, which are single slots.

The male section 502 has a central section 507 extending from the attachment location 505 as described above. The central section 507 has a cavity 516 with a lid 510. This cavity can be used to store objects as desired by a user, including medicine or other items. In the current disclosure, the lid 510 and the bottom surface (not shown) of the central section 507, seen in FIG. 20, form a large section of the top and bottom surface of the closed buckle 500. The two sections interlock as described above.

Figure 22:
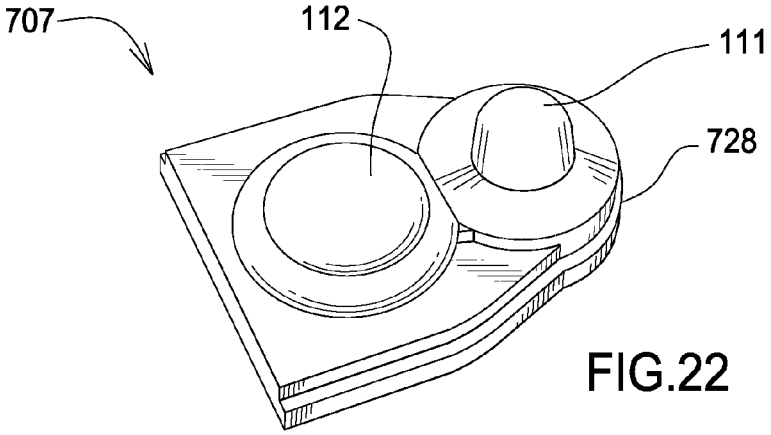
FIG. 22 is a top perspective view of an alternate embodiment of the central section of the male section.
Figure 23:
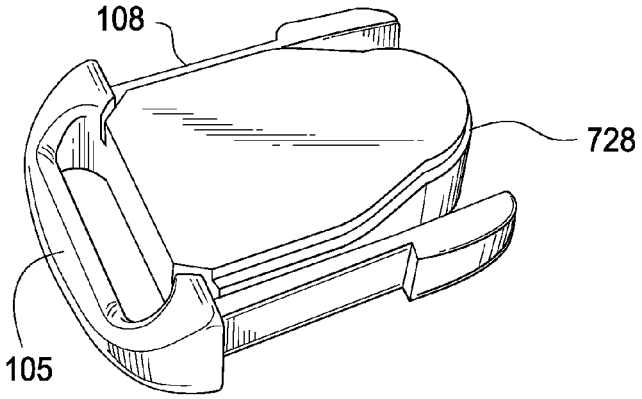
FIG. 23 is a bottom perspective view of the male section of FIG. 22.
Figure 24:
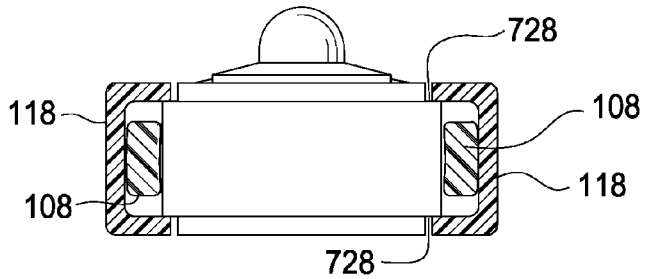
FIG. 24 is a partial cut away view of the central section of FIG. 22 inside the female section.

FIGS. 22 to 24 show an alternate embodiment of the stabilizing mechanism. FIG. 22 shows only the center section with the other sections of the buckle removed for clarity. In this embodiment the center section 707 has a ridge 728 around its side wall. As seen in FIG. 24, the ridge 728 extends under the arms 118 when the buckle is closed. This stabilizes the buckle from flexing along the longitudinal axis of the buckle.

Figure 25:
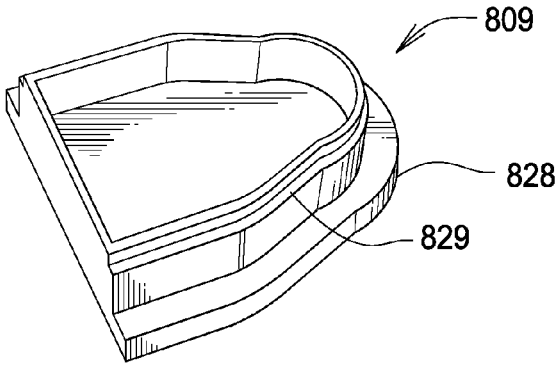
FIG. 25 is a perspective view of an alternate embodiment of the base of the central section.
Figure 26:
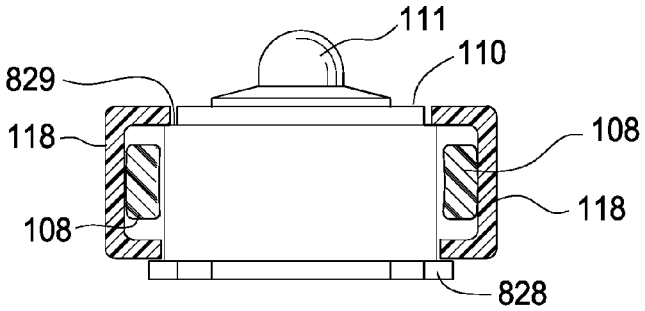
FIG. 26 is a partial cut away view of the central section of FIG. 25 inside a female section.

FIGS. 25 and 26 show another possible stabilizing mechanism for the closed buckle. FIG. 25 shows only the base of the cavity 809, all other parts being removed for clarity. The base of the cavity 809 has a ridge 828 extending from its base and a groove 829 around the lid. When the buckle is closed, the arms 118 of the female part extend over the ridge 829 and the ridge 828 extends over the arms 188 on the bottom of the buckle, as seen in the partial cut away view of FIG. 26.

While a number of exemplary aspects and embodiments have been discussed above, those of skill in the art will recognize certain modifications, permutations, additions and sub-combinations therefor. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and subcombinations possible of the group are intended to be individually included in the disclosure.

In general the terms and phrases used herein have their art-recognized meaning, which can be found by reference to standard texts, journal references and contexts known to those skilled in the art. The above definitions are provided to clarify their specific use in the context of the invention.

I claim:

1. A side squeeze buckle comprising:

a female section comprising a first attachment location having a top surface and a bottom surface, and a pair of opposing arms extending from the first attachment location;

the opposing arms being substantially parallel to each other and having a top and a bottom surface that is contiguous with the top and bottom surfaces of the first attachment location, the top and bottom surfaces of the arms extending around central openings;

at least one of the side walls of the opposing arms of the female section having a hole;

a male section having a second attachment location, a central section extending from the second attachment location and at least one arm with a tab extending alongside the central section, said tab engaging with the hole of the at least one of the opposing arms of the female section to lock the buckle in a closed position;

the central section having a top and bottom surface and a completely enclosed cavity formed therebetween;

at least a portion of the top surface of the central section being formed as removable lid of the enclosed cavity; and the central section fits into the central openings between the opposing arms of the female section when the side squeeze buckle is in the closed position.

2. The side squeeze buckle of claim 1 wherein the top surface of the central section forms the top surface of the closed buckle with the top surface of the first attachment location and the top surface of the opposing arms when the side squeeze buckle is in the closed position.

3. The side squeeze buckle of claim 2, wherein the enclosed cavity contains at least a portion of an LED, a control circuit for the LED and a power source for the LED and wherein at least a second portion of the LED defines an exterior portion of the central section of the male section such that the LED is visible when the buckle is in the closed position.

4. The side squeeze buckle of claim 3 further comprising a switch to control the LED.

5. The side squeeze buckle of claim 4, wherein the switch is on an exterior surface of the buckle when the buckle is in the closed position.

6. The side squeeze buckle of claim 3, wherein the second portion of the LED defines an exterior portion of one of the top or bottom surface of the central section.

7. The side squeeze buckle of claim 3, wherein the second portion of the LED extends beyond the top surface of one of the opposing arms of the female section when the buckle is in the closed position.

8. The side squeeze buckle of claim 1, wherein a portion of the central section interacts with a portion of the female section to stabilize the closed buckle in place.

9. The side squeeze buckle of claim 8, wherein the central section has a groove that interacts with a tab on the female section to stabilize the closed buckle in place.

10. The side squeeze buckle of claim 8, wherein the central section has a groove that interacts with the opposing arms of the female section to stabilize the closed buckle in place.

11. The side squeeze buckle of claim 8, wherein the central section has a groove and a ridge that interacts with the opposing arms of the female section to stabilize the closed buckle in place.

* * * * *